United States Patent [19]

Daus, Jr. et al.

[11] 4,056,327

[45] Nov. 1, 1977

[54] CORNER CONNECTOR

[75] Inventors: John J. Daus, Jr.; Henry E. James; Thomas L. Reinhart, all of Evansville, Ind.

[73] Assignee: Anchor Industries, Inc., Evansville, Ind.

[21] Appl. No.: 659,410

[22] Filed: Feb. 19, 1976

[51] Int. Cl.[2] ..... F16L 41/00

[52] U.S. Cl. ..... 403/172; 135/3 R; 135/DIG. 9; 403/218

[58] Field of Search ..... 52/81, 648, 758 C; 403/170–173, 176, 217, 218, 312; 135/3 R, DIG. 9

[56] References Cited

U.S. PATENT DOCUMENTS

| | | | |
|---|---|---|---|
| 1,931,400 | 10/1933 | Williams | 52/758 CX |
| 2,124,519 | 7/1938 | Piersen et al. | 52/758 C |
| 2,243,687 | 5/1941 | Sutherland | 403/173 |
| 2,788,096 | 4/1957 | Franks | 403/176 |
| 3,315,994 | 4/1967 | Rifken | 403/171 X |
| 3,507,526 | 4/1970 | Packman et al. | 403/173 |

FOREIGN PATENT DOCUMENTS

| | | | |
|---|---|---|---|
| 371,868 | 9/1963 | Switzerland | 135/5 A |

*Primary Examiner*—Werner H. Schroeder
*Assistant Examiner*—Conrad L. Berman
*Attorney, Agent, or Firm*—Warren D. Flackbert

[57] ABSTRACT

A tent frame assembly characterized by a two-part corner member or casting secured together by an independent nut and bolt arrangement, where the nut is dimensioned so as to permit ready grasping and tightening during the assembly procedure. The invention further includes a pre-positioned rotatable sleeve forming part of a corner brace assembly to expedite installation and to achieve a stabilized frame.

1 Claim, 5 Drawing Figures

CORNER CONNECTOR

As is known, the popularity and use of tents, for camping, social activities and the like, is wide-spread. In this connection, it is desirable to erect a tent at a desired site in a positive and yet time saving manner. One approach has been the use of a metal tent frame, such being rugged; lightweight, through the use of aluminum castings and tubular aluminum struts; and, easily assembled.

The invention, however, affords a further convenience and practicality in the erection of a metal tent frame. Briefly, corner members or castings are provided which are defined by two cooperating sections. When the latter are assembled, the resulting configuration readily receives struts defining the overall frame unit. In other words, the corner members permit the ready assembly of a vertical or support strut, the horizontal struts representing an eave line, and the upwardly angling struts representing a roof line.

A presented feature of the invention is the use of an independent fastening member, such as a bolt, for assembling the outer and inner sections of each corner member or casting. Additionally, and in order to achieve effective tightening action, an extended or elongated nut is used in connection with the bolt, being readily engaged by a wrench or like tool during the assembly operation.

Another feature presented by the invention is the partial preassembly arrangement of a brace member at a corner of the tent frame. In other words, one or more rotatable sleeves, at preselected positions on frame members, readily receive a brace member, greatly simplifying the installation procedure.

The importance of the invention lies in features which assist in the positive and rapid erection of a tent frame, being not only convenient, but minimizing time and expense in the installation operation.

A better understanding of the present invention will become more apparent from the following description, taken in conjunction with the accompanying drawings, wherein FIG. 1 is a top plan view of a corner member or casting in accordance with the teachings of the present invention;

Figure 1:
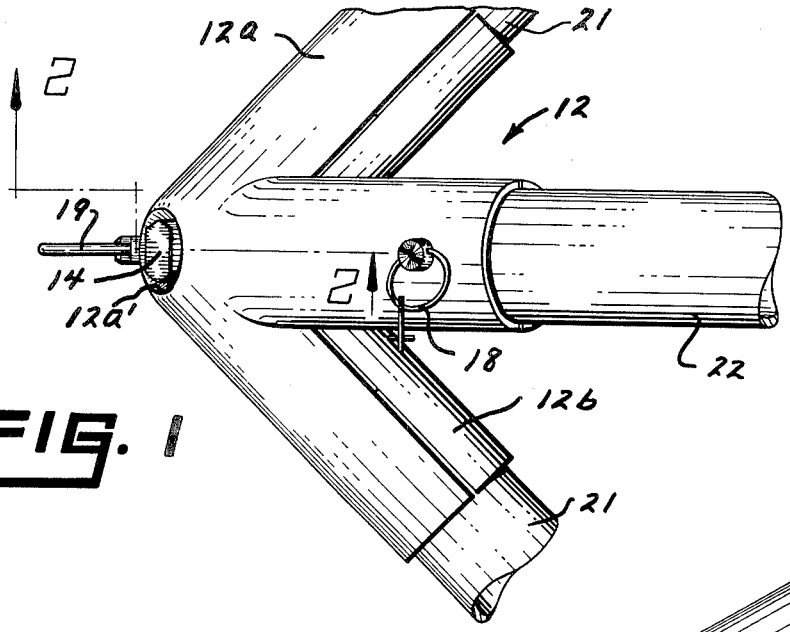

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications of the illustrated device and such further applications of the principles of the invention as illustrated therein being contemplated as would normally occur to one skilled in the art to which the invention relates.

Figure 2:
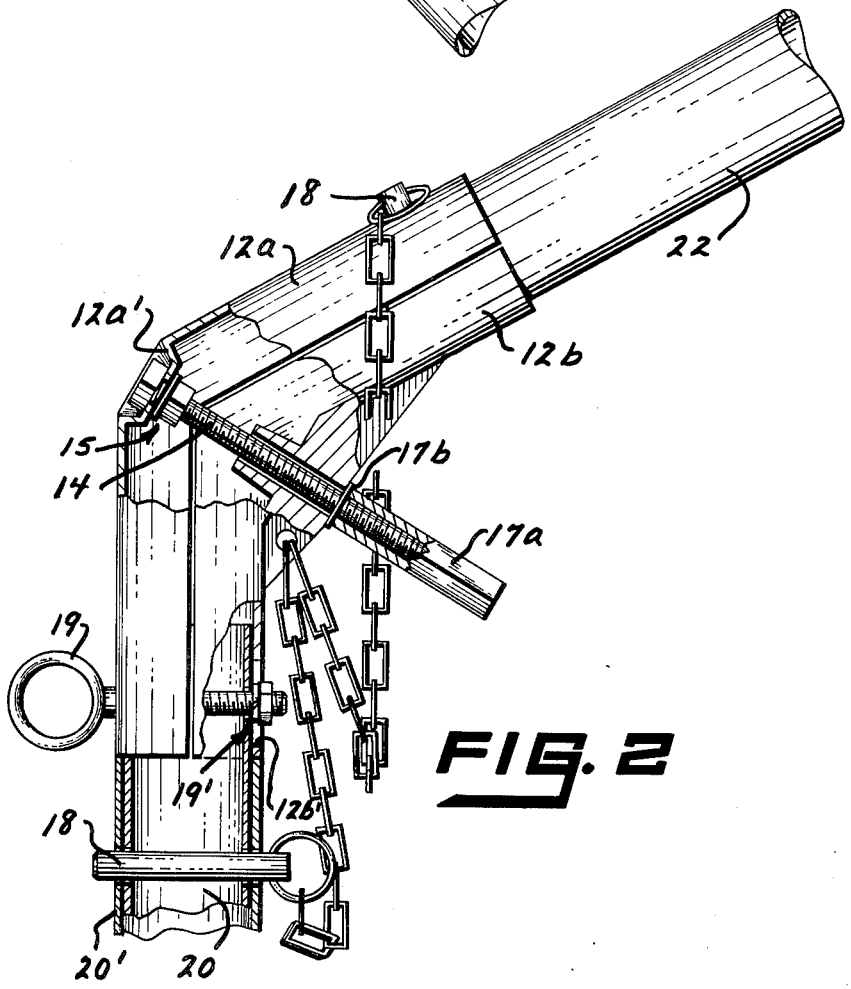
FIG. 2 is a view in elevation, taken at line 2—2, of FIG. 1 and looking in the direction of the arrows, showing further details of an assembled corner member.
Figures 3, 4, 5:
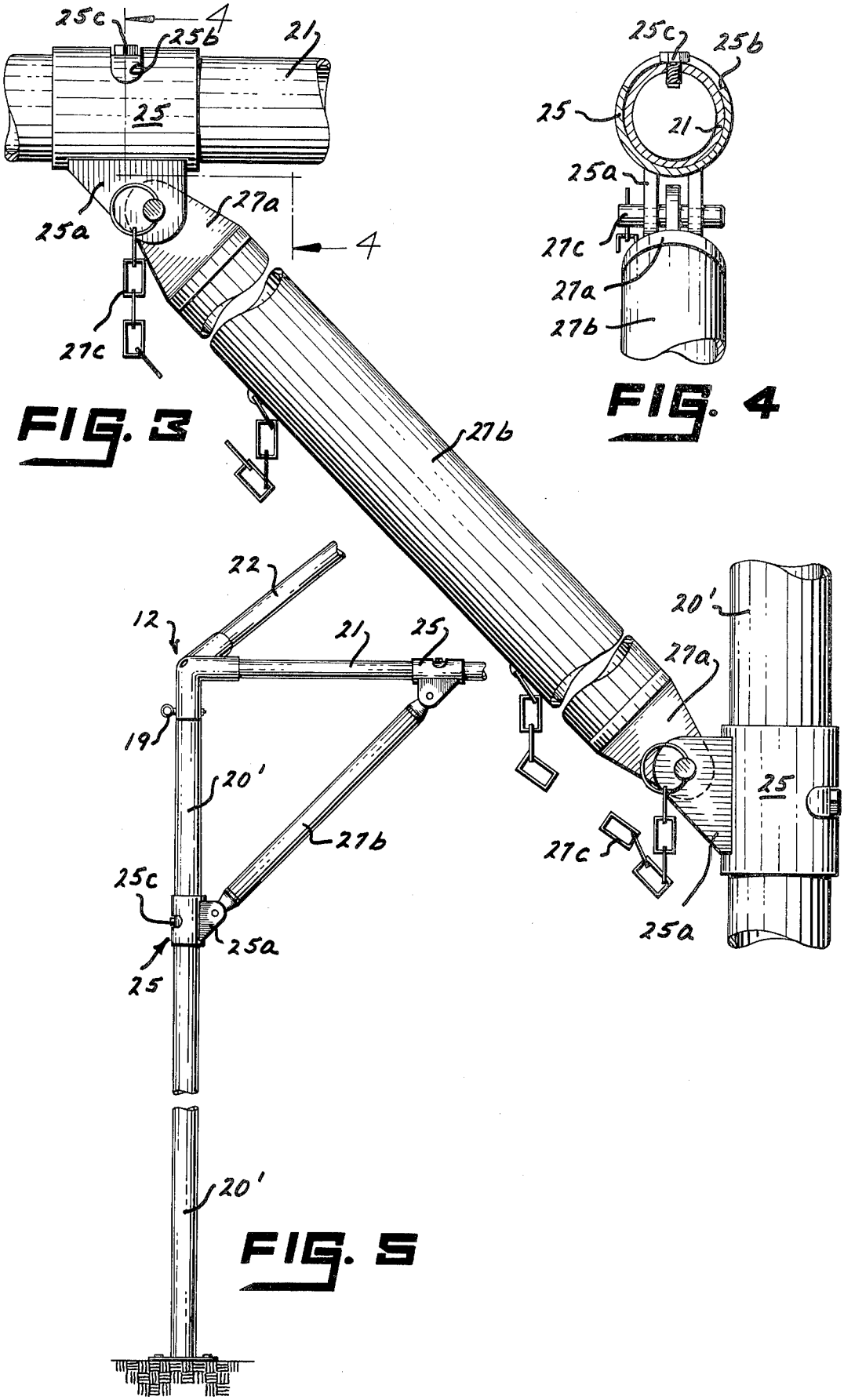
FIG. 3 is a view in side elevation of a corner brace assembly of the invention.
FIG. 4 is a fragmentary view in elevation, generally taken at line 4—4 of FIG. 3 and looking in the direction of the arrows, showing additional details of a corner brace assembly; and, FIG. 5 is a further view in elevation, partly fragmentary, showing a typical installation utilizing a corner and a corner brace assembly in accordance with the invention.

Referring now to FIGS. 1, 2 and 5, the corner assembly of the invention is defined by a two-part member or casting 12, i.e. an outer section **12*a* and an inner section 12*b*. Each assembled corner includes cooperating hollow arm portions for receiving frame members in the form of an inner support strut 20, eave struts 21 and a roof strut 22**.

The outer section **12*a* of the corner assembly has a recess 12*a'* into which the head of a separate or independent assembly bolt 14 is received, such bolt 14 extending through a complementary opening in the inner section 12*b*. The bolt 14 is retained on, and movable with, the outer secion 12*a* by means of a nut and washer arrangement 15. When assembly is completed, and as particularly evident in FIG. 2, the fastening of the outer section 12*a* and the inner section 12*b* is positively achieved through an extended nut 17*a* and a washer 17*b***.

The preceding arrangement provides important features for installation. In this connection, the use of an independent assembly bolt 14 is superior to any fastening by a member which is an integral part of the outer secion **12*a*. Additionally, it should be noted that the extended nut 17*a* is of such length and proportions to permit ready grasping by a tool used by the installation worker. Thus, nut 17*a*** is easily rotated to a tightened position.

In the assembly of a corner, the provision of chain and pin arrangements 18 assure the proper joining, for example, of inner support strut 20, an outer support strut 20', and the roof strut 22 with the corner member or casting 12. In other words, the aforesaid frame members are pinned into position.

The overall frame assembly is completed by the use of an eye bolt 19 for receiving a guy line (not shown), such eye bolt 19 being secured, by nut and washer arrangement 19', to the outer section **12*a* and the inner support strut 20, so that such components move as a unit. An opening 12*b'* is provided on the inner section 12*b*** to permit ready assembly.

FIGS. 3 and 4, together with FIG. 5, illustrate a corner brace assembly of the invention. In this connection, the eave strut 21 receives a sleeve or collar 25 having depending spaced-apart arms **25*a* between which an end member 27*a* on a corner brace strut 27*b* is introduced. The collar 25 has a radial slot 25*b* therein, which collar 25 is selectively positioned on the eave strut 21 by, typically, a cold rivet 25*c* extending through the slot 25*b* and into the eave strut 21. Thus, the collar 25 cannot move longitudinally along the eave strut 21, but can be rotated within the limits of the slot 25*b***.

In other words, the collar 25 is prepositioned on the eave strut 21, as at the factory, for example, minimizing assembly difficulties at the erection site. The arrangement permits rotation of collar 25 during installation and as well, affords versatility in the achieving of a stable corner assembly.

The corner brace strut **27*b* further includes chain and pin arrangements 27*c*, disposed proximate opposite ends thereof, to assure convenient and positive placement, as in FIG. 3. While it is preferable to use a rotatable collar 25 on the outer support strut 20', as shown, it should be noted that a fixed collar might be used at one end of corner brace strut 27*b*** and a rotatable collar at the opposite end.

The invention provides convenience in the positive assembly of an overall tent frame, a portion of the latter being shown in FIG. 5. As a matter of restatement, the outer and inner sections 12*a* and 12*b* of the corner casting are readily assembled by the independent assembly bolt 14, to which the elongated nut 17*a* is easily secured. Additionally, the slotted collars 25 in the corner brace assembly are at a preestablished position on the desired frame members, and are rotatable. The preceding afford significant advantages in the installation procedure.

It should be understood, however, that the described tent frame assembly is susceptible to various changes within the spirit of the invention, as, for example, in proportioning and the like. Thus, the above description should be considered illustrative and not as limiting the scope of the following claim.

We claim:

1. A two-part corner member defined as an outer member and an inner member, said outer member and said inner member each arranged to include four corresponding and converging arm sections which fit together to encircle and receive tubular frame members, two of said arm sections being at a right angle to each other and in the same horizontal plane, another of said arm sections being vertically disposed, and the other of said arm sections angling upwardly and inwardly with respect to said two of said arm sections, and independent bolt and nut fastening means extending through said outer member and said inner member at the area of convergence of said arm sections selectively securing said outer member and said inner member in an assembled relationship.

* * * * *